US005157940A

United States Patent [19]

Bertu et al.

[11] Patent Number: 5,157,940

[45] Date of Patent: Oct. 27, 1992

[54] REFRIGERATION, FREEZER OR THE LIKE WITH AN AUTOMATICALLY CLOSING AND OPENING REMOVABLE CONTAINER IN WHICH VACUUM IS PRODUCED

[75] Inventors: Angelo Bertu, Biandronno; Giovanni Franzetti, Ispra; Franco Germi, Gavirate, all of Italy

[73] Assignee: Whirlpool International B.V., Eindhoven, Netherlands

[21] Appl. No.: 647,129

[22] Filed: Jan. 29, 1991

[30] Foreign Application Priority Data

Feb. 1, 1990 [IT] Italy ..... 19215 A/90

[51] Int. Cl.[5] ..... F25D 25/02

[52] U.S. Cl. ..... 62/382; 62/268

[58] Field of Search ..... 62/100, 382, 268; 312/214, 236

[56] References Cited

U.S. PATENT DOCUMENTS

| | | | |
|---|---|---|---|
| 2,119,320 | 5/1938 | Dobrowsky | 62/268 |
| 2,425,816 | 8/1947 | Maxson | 62/268 |
| 2,894,845 | 7/1959 | Stoddard | 62/268 |
| 3,067,588 | 12/1962 | Whitmore | 62/268 |
| 3,216,214 | 11/1965 | Gasbarro | 62/268 |
| 4,584,841 | 4/1986 | Guillaume et al. | 62/268 |
| 4,788,832 | 12/1988 | Aoki | 62/382 |

*Primary Examiner*—Ronald C. Capossela

*Attorney, Agent, or Firm*—Thomas J. Roth; Stephen D. Krefman; Thomas E. Turcotte

[57] ABSTRACT

A refrigerator, freezer or the like comprises a cabinet (1), a pump (6) for producing vacuum and, in a refrigeration compartment (10) thereof, a container (17) closable in a vacuum-tight manner and able to be moved within said compartment (10), said container (17) comprising a lid (19) guided to open and close during its movement by elements (40) associated with said lid (19), which moves in guide tracks (41) provided in opposing walls (16) of said compartment (10) or in elements (42) associated with said walls (16), there being provided on said lid (19) mobile members (48) associated with pins (46, 50) acting as hinges about which, during the movement of said lid (19), said members (48) rotate under the action of a thrust exerted by pusher means (51), said movement taking (48), during their rotation about said pins (46, 50), exceed an equilibrium position beyond which the pusher means (51) act to provide independent guided movement of said lid (19).

8 Claims, 3 Drawing Sheets

REFRIGERATION, FREEZER OR THE LIKE WITH AN AUTOMATICALLY CLOSING AND OPENING REMOVABLE CONTAINER IN WHICH VACUUM IS PRODUCED

This invention relates to a refrigerator, freezer or the like provided in particular with a compartment in which vacuum is produced by means of a normal pump.

It is well known that the cold preservation of foods under vacuum has considerable advantages. In particular, it enables such foods to be kept in a refrigerator or the like without degrading. With particular reference to domestic refrigerators, various methods have already been proposed for providing in the refrigerator a compartment having its own door and connected to a vacuum pump.

One such method forms the subject of a preceding patent application of the present application. According to this, in a refrigeration compartment of a refrigerator, freezer or the like there is provided a container closable in a vacuum-tight manner and able to be moved within said compartment, said container being provided with a pipe through which the vacuum is produced and which is arranged to cooperate with a counter-pipe provided in the usual cabinet of the refrigerator or the like and opening into a wall of said compartment, said counter-pipe being connected to the vacuum pump, at least one of the cooperating ends of said pipes comprising a hollow elastic element arranged to form a seal against the other end.

This method results in various advantages such as considerable constructional simplicity of the refrigerator, low production cost, ease of access to the compartment in which the vacuum is provided, and its ease of cleaning.

However, such a construction has various drawbacks, such as the possibly imperfect closure of the lid of the container during its reinsertion into the refrigeration compartment after being extracted from it, and possibly imperfect connection between the pipe associated with the container and the relative counter-pipe.

An object of the present invention is therefore to provide a refrigerator or the like comprising a movable container internally under vacuum, which obviates the drawbacks of known constructions. A particular object is to provide a refrigerator of the aforesaid type with improved closure of the lid on the container and in which the usual seal gasket provided on the edges of said container and/or lid is subjected to less stress during the opening of this latter, resulting in longer life.

A further object is to provide a refrigerator of the aforesaid type having an improved and more reliable connection between the pipe associated with the container and the relative counter-pipe connected to the vacuum pump.

A further object is to provide a refrigerator of the aforesaid type in which access to the container interior is simpler. A further particular object is to allow simple opening of and access to the container for a user having one hand occupied with the foods to be placed in said container.

These and further objects which will be apparent to the expert of the art are attained by a refrigerator, freezer or the like comprising a cabinet, a pump for producing vacuum and, in a refrigeration compartment thereof, a container closable in a vacuum-tight manner and able to be moved within said compartment said container comprising a lid guided to open and close during its movement by elements associated with said lid and moving in guide tracks provided on opposing walls of said compartment, or in elements associated with said walls, on said lid there being provided mobile members associated with pins acting as hinges about which, during the movement of said lid, said members rotate under the action of a thrust exerted by pusher means, said movement taking place jointly with that of the lid until said members, during their rotation about said pins, exceed an equilibrium position beyond which the pusher means act to provide independent guided movement of said lid.

The invention will be more apparent from the accompanying drawing, which is provided by way of non-limiting example and in which.

Figure 1:
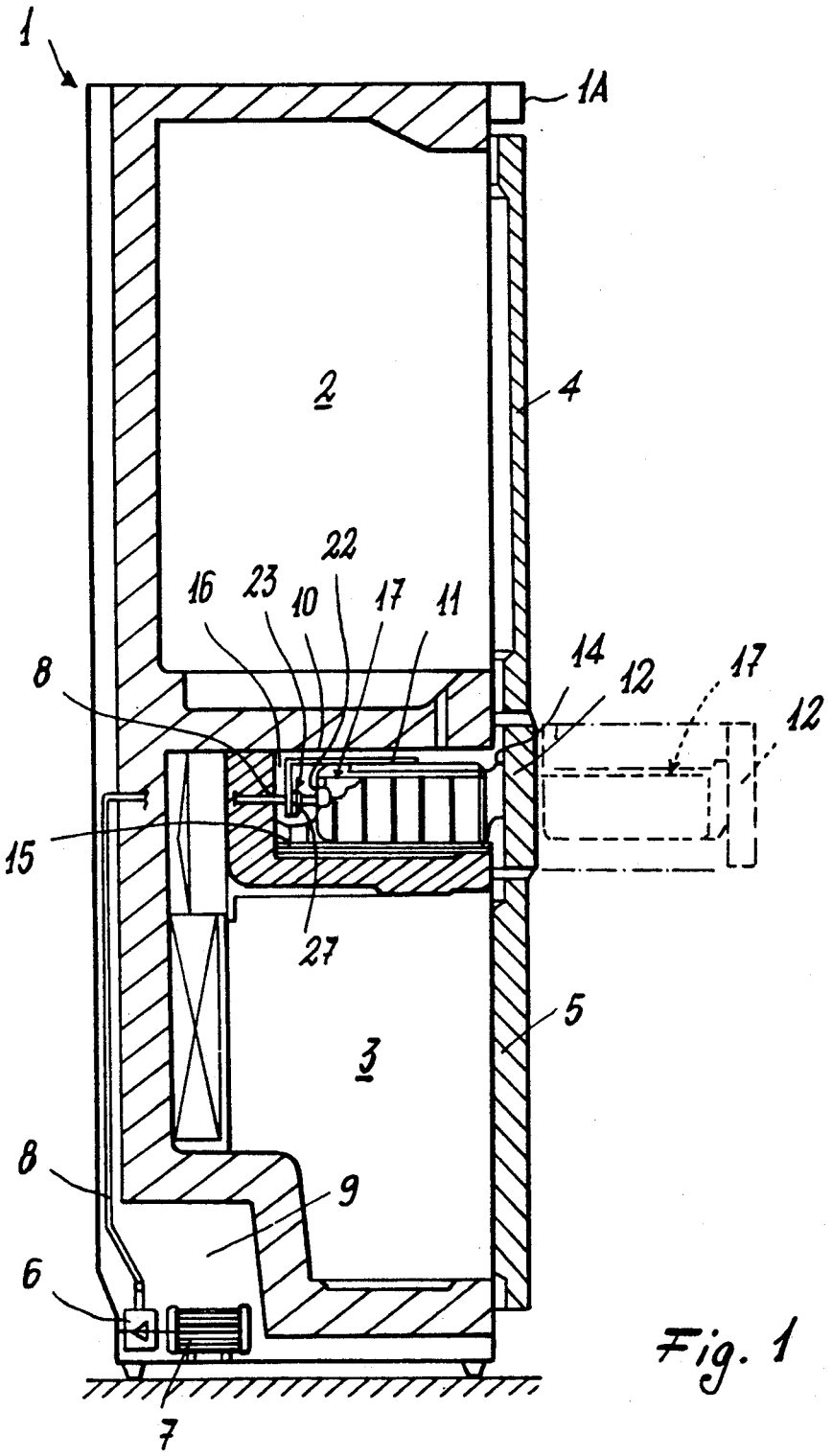
FIG. 1 is a vertical section through a domestic refrigerator constructed in accordance with the invention.

With reference to said Figures, a refrigerator or freezer comprises a cabinet 1 containing normal refrigeration and freezer compartments 2 and 3 provided with their own closure doors 4 and 5. The refrigerator is also provided with a vacuum pump 6, which is operated by an electric motor 7 and from which a pipe 8 extends to terminate in a further compartment 10 positioned between the refrigeration compartment 2 and freezer compartment 3. The pump is located in a chamber 9 provided below the freezer compartment 3.

The compartment 10 is maintained in known manner at a temperature substantially of 0° C. and is connected to the refrigeration compartment 2 by a duct 11. Said compartment 10 is provided with its own door 12, which is connected to a support or basket 14 slidable on guides 15 associated with walls 16 of the compartment. As an alternative to this "drawer-type" embodiment, the door can be hinged to the refrigerator cabinet 1.

A container 17 in which vacuum is to be produced is removably placed in the basket 14. More specifically, said container comprises a lower box part 18 which can be closed in a sealed manner by a lid 19. The box part 18 comprises within its rear wall 22 a pipe (not shown) connected to a sucker element (or simply sucker) 23 which is disposed on the outside of said part 18 and is fixed to it in any known manner. The duct opens into the free end 26 of the sucker; this latter end is arranged to cooperate with a plate 27 into which the pipe 8 connected to the vacuum pump 6 opens via a suitable aperture, not shown. A usual filter element can be advantageously associated with the plate 27.

According to one characteristic of the invention the plate 27 is supported by an elastically deformable substantially L-shaped bracket 30 which is fixed to an element 31 positioned transversely above the container 17 and fixed to the walls 16 of the compartment 10 in known manner.

Specifically, the bent portion 32 of the bracket 30 carries on that side 33 facing the container 17 the plate 27 and on its opposite side a connecting element 35 for connection to said pipe 8. A further duct (not shown) is provided within said bent portion 32 for connecting said pipe 8 to the aperture in the plate 27.

The bracket 30 also supports a pin 37 fixed to the non-bent part 38 which extends above the container. This pin projects from said part 38 towards the container 17 and is arranged to cooperate with an advantageously fork-shaped member 39 rigid with the lid 19 when said container is inserted into the compartment 10, said pin 37 acting as a stop for this insertion.

According to a further characteristic of the invention the lid 19 carries laterally two elements or pins 40 which slide in cams or guide tracks 41 provided in panels 42 rigid with the walls 16 of the compartment 10; alternatively, said cams are provided in the walls 16 themselves.

A further characteristic of the invention is that said transverse element carries bracket-shaped supports 45 which project from said element 31 and to each of which there is fixed a first pin 46. To each pin 46 there is pivoted a first for example fork-shaped free end 47 of a substantially cylindrical member 48, the other free end 49 of which is connected to a second pin 50 rigid with the lid 19.

Figure 2:
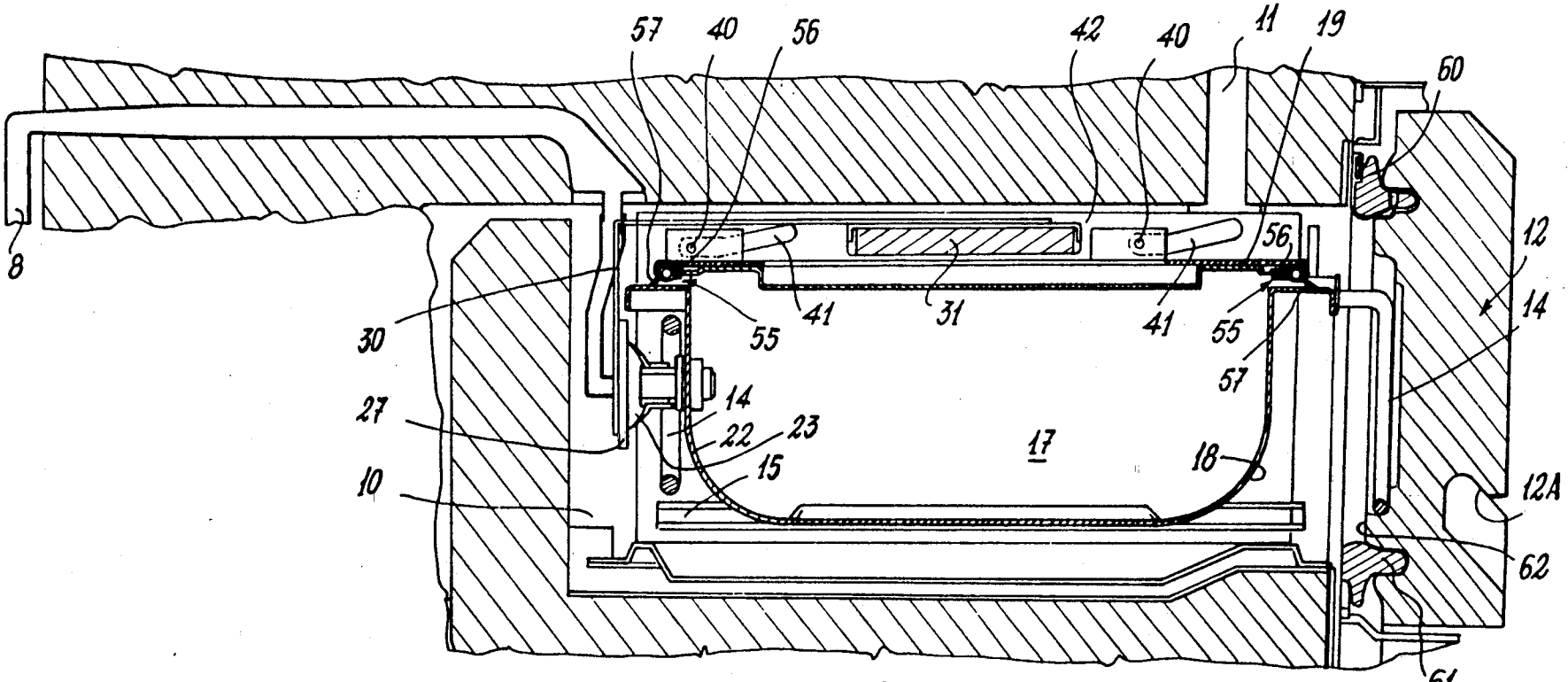
FIG. 2 is a cross-section through part of the refrigerator of FIG. 1.
Figure 3:
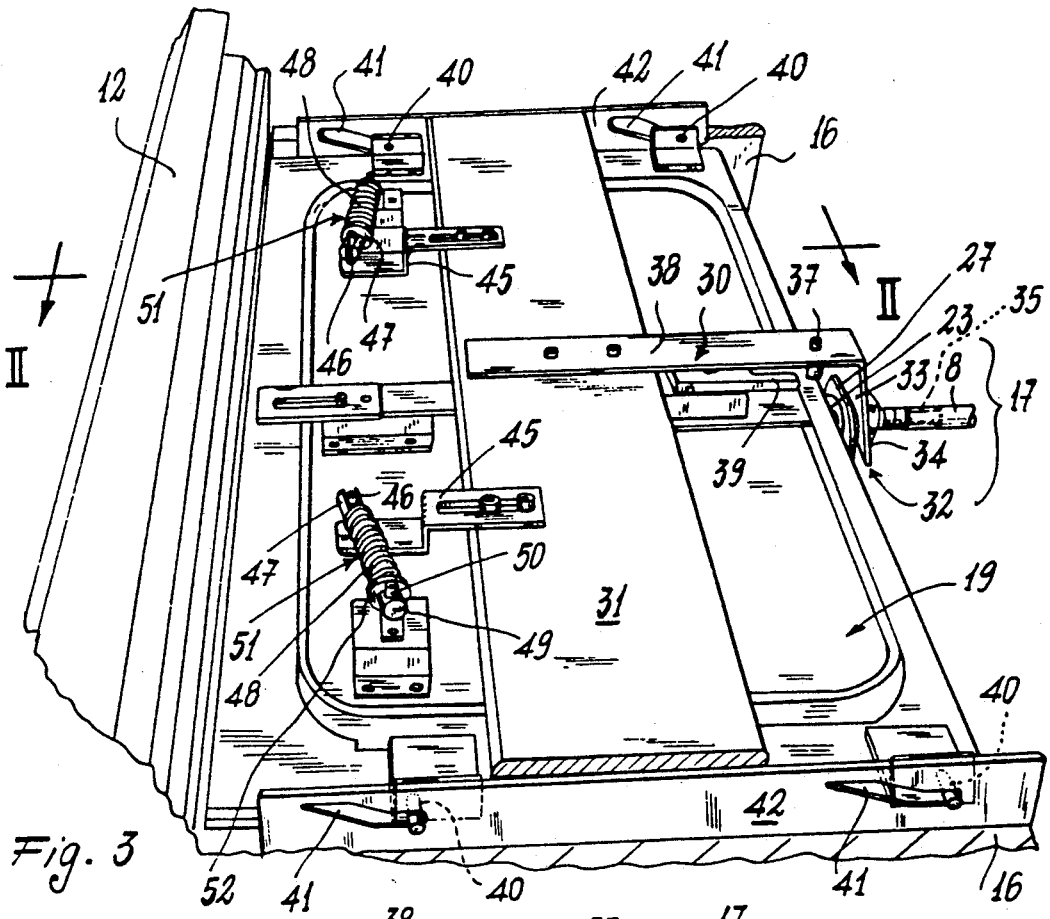
FIG. 3 is a perspective enlarged rear view of that part of the refrigerator shown in FIG. 2.
Figure 4:
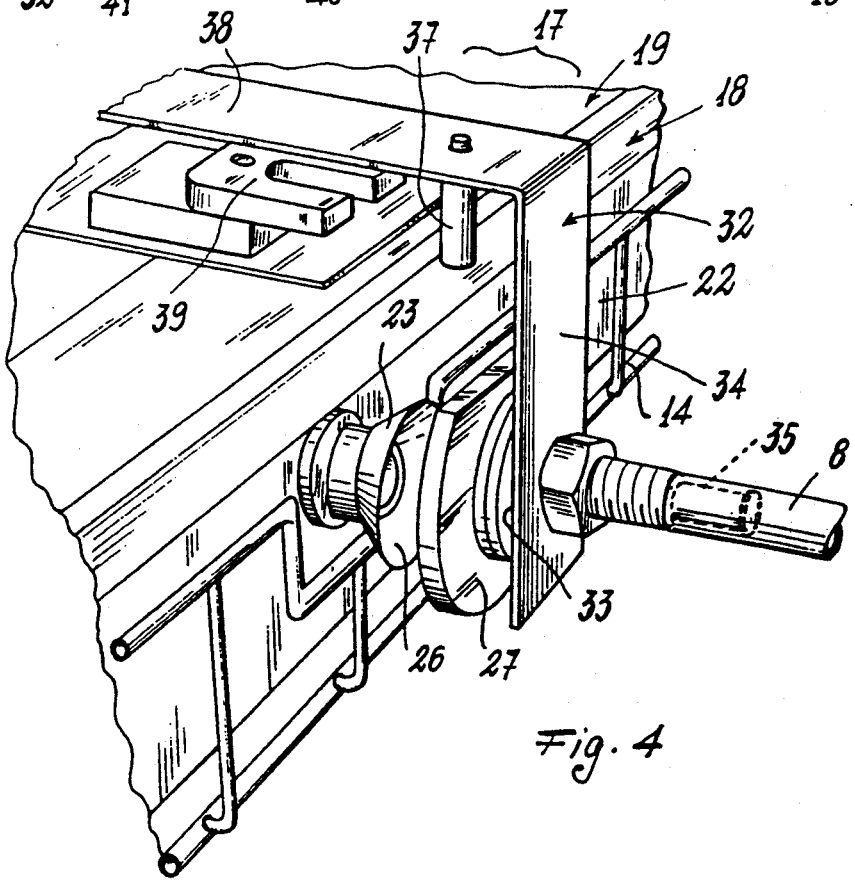
FIG. 4 is a perspective enlarged rear view of that part of the refrigerator shown in FIG. 2, during one stage in its use.

About each member 48 there is provided a compression spring 51, the free end of which acts on an end element 52 of each member 48, its other end acting on the fork-shaped end 47 of said members. Lastly (see FIG. 2), along the edge of the lid 19 there is positioned a seal gasket 55 comprising a first part 56 with two superimposed parallel flat portions (this part being forked shaped in the cross-sectional view of FIG. 2); the part 56 being mounted over the edge of the lid. The gasket also comprises a second part 57 arranged to cooperate with the box part 18 of the container 17. Such a gasket enables a good seal to be obtained and allows a good vacuum to be reached in said container by preventing any air seeping into it.

Other gaskets 60 and 61 are provided on that wall 62 of the door 12 which faces the front wall 1A of the refrigerator cabinet. It will now be assumed that the door or drawer 12 is closed and the container 17 located in the compartment 10 has been inserted into it such that the sucker 23 is in contact with the plate 27. If the vacuum pump 6 is now operated (for example by a usual pushbutton located on the front 1A of the refrigerator cabinet 1), the suction produced by the pump acts on the sucker 23 via the pipe 8, to thus pull the sucker (and hence the container 17). Following this, as said container is located in the basket 14 which is associated with the door 12, said door also closes perfectly against the refrigerator cabinet 1.

Excellent engagement is obtained between the sucker 23 and plate 27 by virtue of the presence of the bracket 30 and its elasticity. After contact has been obtained between the sucker and plate, vacuum is obtained in the container 17 in known manner. If access is now required to the container 17, a handgrip (indicated by 12A in FIG. 2) provided for this purpose on the door 12 is pulled to open it.

As the door begins to open, the container 17 (rigid with it) moves within the compartment 10. Initially, as the sucker 23 and the plate 27 are in mutual contact and are associated with each other, the movement of the container also results in bending of the bracket 30, this bending continuing until the elastic force of this latter returns it to its original position, with consequent separation between the sucker and plate. The vacuum is consequently broken in the container 17. As the opening of the door 12 continues, the fact that there is no longer any vacuum in said container means that its lid 19 separates from its box part 18.

This occurs by the pins or lateral elements 40 sliding in the guide tracks 41. As these latter are shaped to guide these elements upwards (relative to the compartment 10), the movement of the container 17 results in the lifting of the lid 19 from the box part 18.

The lid moves together with the box part 18 while the sucker 23 is still associated with the plate 27. Under these conditions the members 48 rotate about the pins 46 and 50 until their axis (that which passes through said pins) is parallel to the transverse element 31.

When said sucker separates from the plate 27, with consequent breaking of the vacuum, these members have already passed, if only slightly, beyond the position in which they are parallel to the element 31 (known as the equilibrium position). At this point the springs 51 act by pushing against the ends 47 and 52 of the members 48, with consequent rotation of these latter about the pins 46 and 50, with the result that the lid 19 moves independently of the box part 18.

In this manner, by completely opening the door 12 and extracting the container 17 from the compartment 10, direct access is gained to the part 18 of said container without any obstruction by the lid 19, which has remained within the compartment 10, and without therefore having to open the lid. This is very useful, particularly if the user's hands are engaged, as it provides simple access to the interior of the container.

We claim:

1. A refrigeration appliance comprising:

a cabinet having at least one closable refrigeration compartment formed therein, said compartment having an inner wall;

a pump mounted to said cabinet for producing a vacuum;

guide tracks provided within said compartment;

a container moveably disposed within said refrigeration compartment, said container further comprising:

a container main body, a selectively closable lid mounted to said container main body, said container being closable in a vacuum-tight manner within said compartment upon movement of said lid into engagement with said container main body;

mounting means moveably mounting said container main body to said guide tracks such as to permit said container to be selectively moved relative to said compartment along said guide tracks;

lid opening means interposed between said lid and said cabinet, said lid opening means guiding said lid to open and close during its movement within said cabinet; and conduit means interconnecting said pump with said container to produce a predetermined reduced atmospheric pressure within said container.

2. The refrigeration appliance of claim 1 wherein said container further comprising hinge means hingedly mounting said lid to said container main body; and said lid opening means further comprises pusher means interposed between said lid and said container such that said lid rotates under the action of a thrust exerted by said pusher means.

3. The refrigeration appliance of claim 1 wherein said mounting means are pins.

4. The refrigeration appliance of claim 1 wherein said guide means are fixedly secured to said wall of said compartment.

5. The refrigeration appliance of claim 2 wherein said lid opening means further comprises:

support means fixedly connected to said walls of said compartment and extending transversely above said container, first pins being carried by said support means, second pins associated with the container lid, and substantially cylindrical mobile members, each having a first fork-shaped free end associated with first pins acting as hinges, and further having a second free end connected to said second pins, such that movement of said container main body along said track means causes movement of said lid along with said container main body until said mobile members, during their rotation about said pins, exceed an equilibrium position beyond which the mobile means act to provide independent guided movement of said lid relative to said container main body.

6. The refrigeration appliance of claim 5 wherein said pusher means are compression springs disposed on said mobile members, said springs cooperating at their free ends with the first free ends of said mobile members and with elements rigid with the second free ends of said mobile members.

7. The refrigeration appliance of claim 5 wherein said support means comprises a bracket element having a side facing the container and carrying said plate, and a side extending over the container and carrying a pin projecting toward this latter to cooperate with said fork-shaped element, said pin acting as a stop to the insertion of the container into the compartment.

8. The refrigeration appliance of claim 1 further comprising a seal gasket extending along the edge of the lid of the container said seal gasket comprising a first part having two superimposed parallel flat parts to be mounted over the edge of said lid, and a second part arranged to cooperate with the box part of said container.

* * * * *